US006447188B2

(12) United States Patent
Ishizaki

(10) Patent No.: US 6,447,188 B2
(45) Date of Patent: Sep. 10, 2002

(54) IMAGE RECORDING APPARATUS

(75) Inventor: Akemi Ishizaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/734,648

(22) Filed: Dec. 13, 2000

(30) Foreign Application Priority Data

Dec. 20, 1999 (JP) ..... 11-361285
Nov. 30, 2000 (JP) ..... 2000-365563

(51) Int. Cl.[7] ..... B41J 3/39; B41J 13/10; B41J 2/435

(52) U.S. Cl. ..... 400/691; 400/629; 400/613; 347/227

(58) Field of Search ..... 400/629, 691, 400/613; 347/227

(56) References Cited

U.S. PATENT DOCUMENTS 4,723,129 A 2/1988 Endo et al.
4,740,796 A 4/1988 Endo et al.
5,813,780 A * 9/1998 Kiyohara et al. ..... 400/629
6,088,049 A * 7/2000 Austin et al. ..... 347/222
6,118,469 A * 9/2000 Hosomi ..... 400/691
6,181,361 B1 * 1/2001 Bluteau et al. ..... 400/613

* cited by examiner

*Primary Examiner*—Andrew H. Hirshfeld
*Assistant Examiner*—Marvin P. Crenshaw
(74) *Attorney, Agent, or Firm*—Fitzpatrick, Cella, Harper & Scinto

(57) ABSTRACT

An image recording apparatus typically comprises a first housing provided with a feeding tray for containing recording mediums before recording by a recording section, a second housing provided with an outlet tray for storing the recording mediums carried from the first housing, and a coupling and carrying device for coupling the first housing and the second housing in such a manner as to be able to displace them relatively. This coupling and carrying device forms a flexible carrier path to guide each recording medium carried from the first housing to the second housing. With the structure thus arranged, this recording apparatus can achieve significant space saving when installed.

8 Claims, 6 Drawing Sheets

IMAGE RECORDING APPARATUS

BACKGROUND OF THE INVENTION

1. Field of the Invention

The present invention relates to an image recording apparatus that records on a recording medium in accordance with image information.

2. Related Background Art

Computers and their peripheral equipment have made progress year after year in performance while, at the same time, being made smaller and available at lower costs. Particularly, with the appearance of notebook type personal computers, for example, the popularity of personal computers is remarkable due to their portability and capability to save installation space. Also, the recording apparatus of ink jet type, which is used as output means thereof, has a considerable market share for personal use, because it is comparatively inexpensive, and is smaller but capable of recording in colors.

Nevertheless, since a conventional recording apparatus of the above-described type is installed horizontally on a desk or the like, it requires at least an area approximately the same size of a recording medium to be used even when it has been made smaller as those currently available on the market. Also, if the unit that contains recording mediums and the unit that carries them out are arranged to face each other in the horizontal direction, the area occupied by the apparatus becomes inevitably larger. There is also a problem that considerable space should be secured on a desk for the installation thereof. With the notebook type personal computer which has increasingly become more popular, the problems of space saving and mobility no longer exist for the computer. Nevertheless, it is still required that the recording apparatus, such as a printer, be capable of saving space when serving as a peripheral device of such computer.

SUMMARY OF THE INVENTION

To meet such demand, the present invention has been designed. It is an object of the invention to provide an image recording apparatus capable of being installed with the smallest space possible.

It is another object of the present invention to provide an image recording apparatus capable of being installed in various places with increased selectivity of installation modes with a smaller space requirement.

It is still another object of the invention to provide an image recording apparatus for recording images on a recording medium by use of recording means, which comprises a first housing provided with a feeding tray for containing recording mediums before recording by use of recording means; a second housing provided with an outlet tray for storing the recording mediums carried from the first housing; and coupling and carrying means for coupling the first housing and the second housing in such a manner as to be able to displace them relatively. This coupling and carrying means forms a flexible carrier path to guide a recording medium carried from the first housing to the second housing.

Other objectives and advantages besides those discussed above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

Figure 1B:
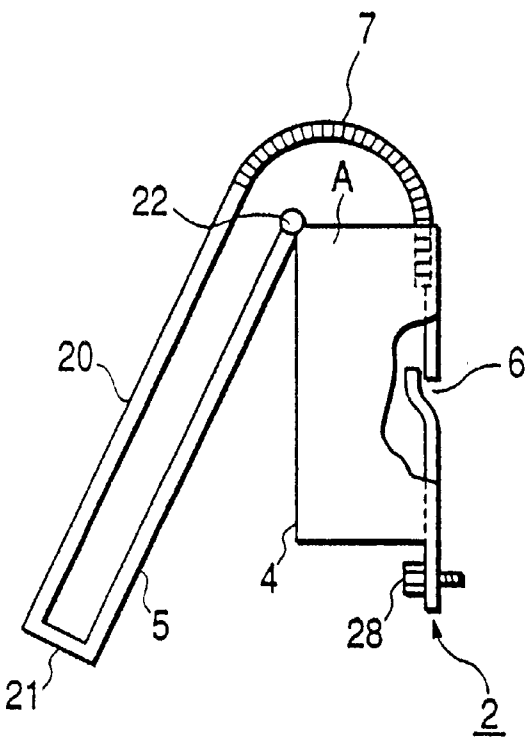
FIGS. 1A and 1B are views which illustrate an image recording apparatus in accordance with a first embodiment of the present invention.
Figure 1A:
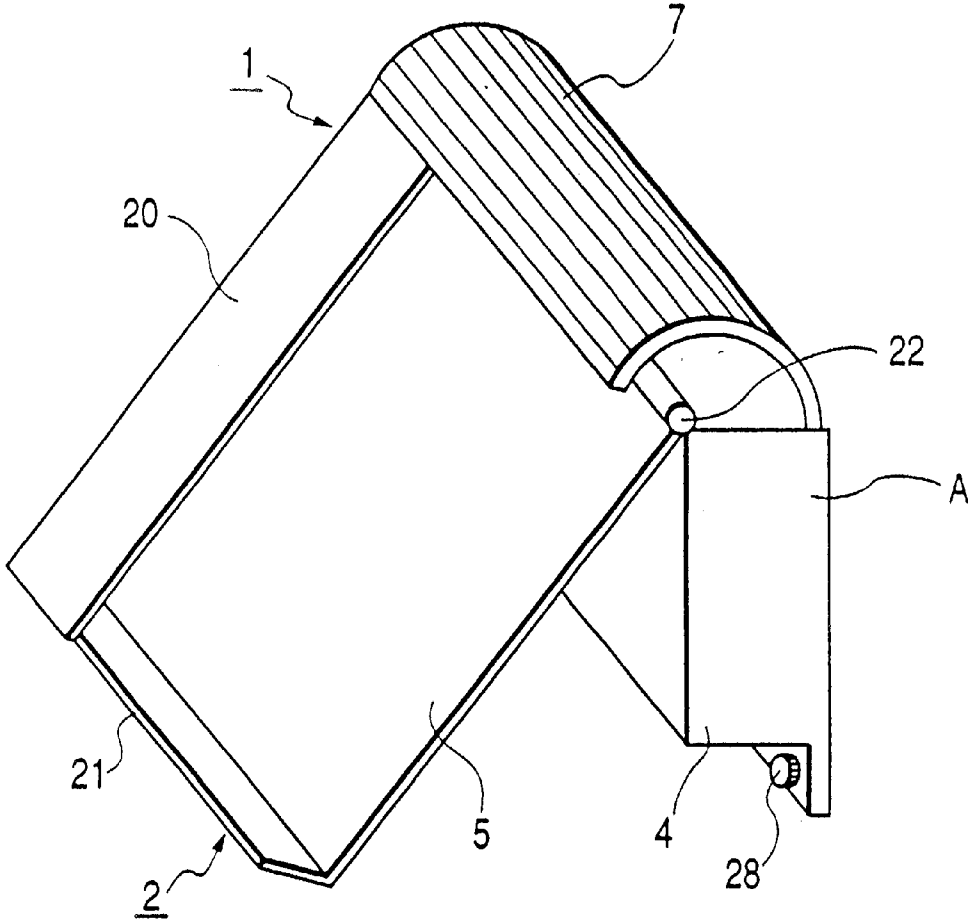
Figure 2B:
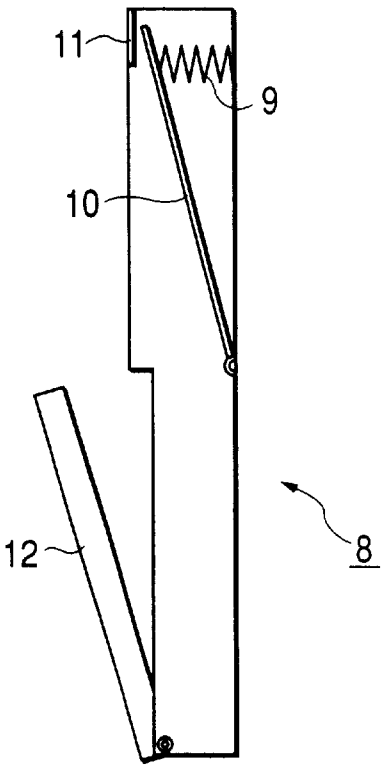
FIGS. 2A and 2B are views which illustrate a feeding cassette.
Figure 2A:
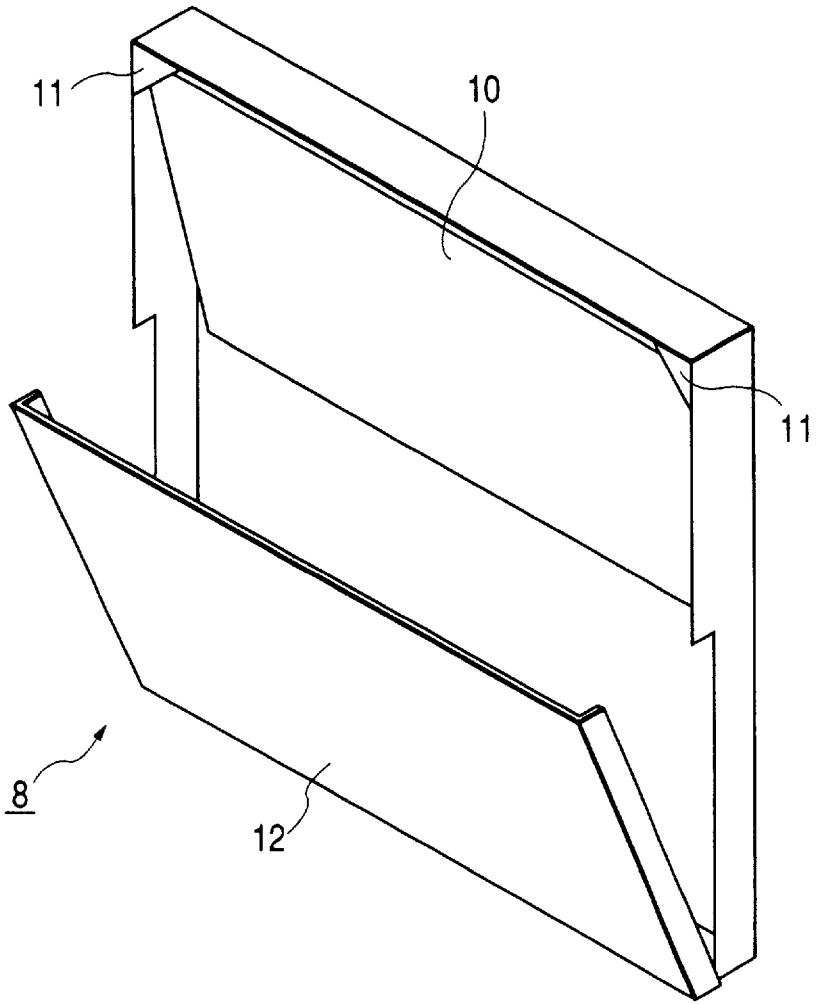
Figure 3:
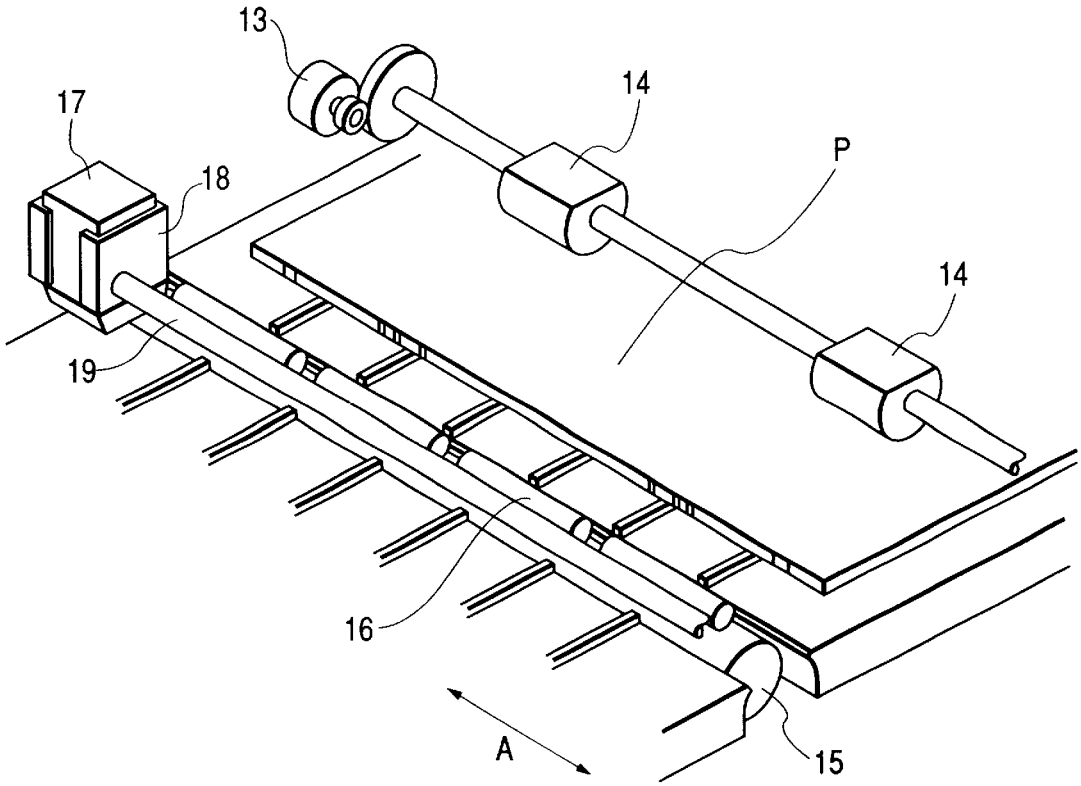
FIG. 3 is a view which illustrates carrying means and recording means.
Figure 4B:
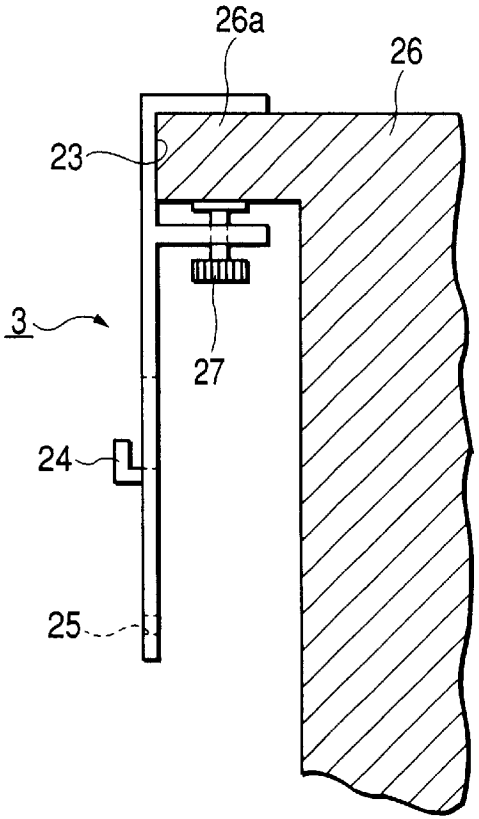
FIGS. 4A and 4B are views which illustrate the way to fix a frame to a desk.
Figure 4A:
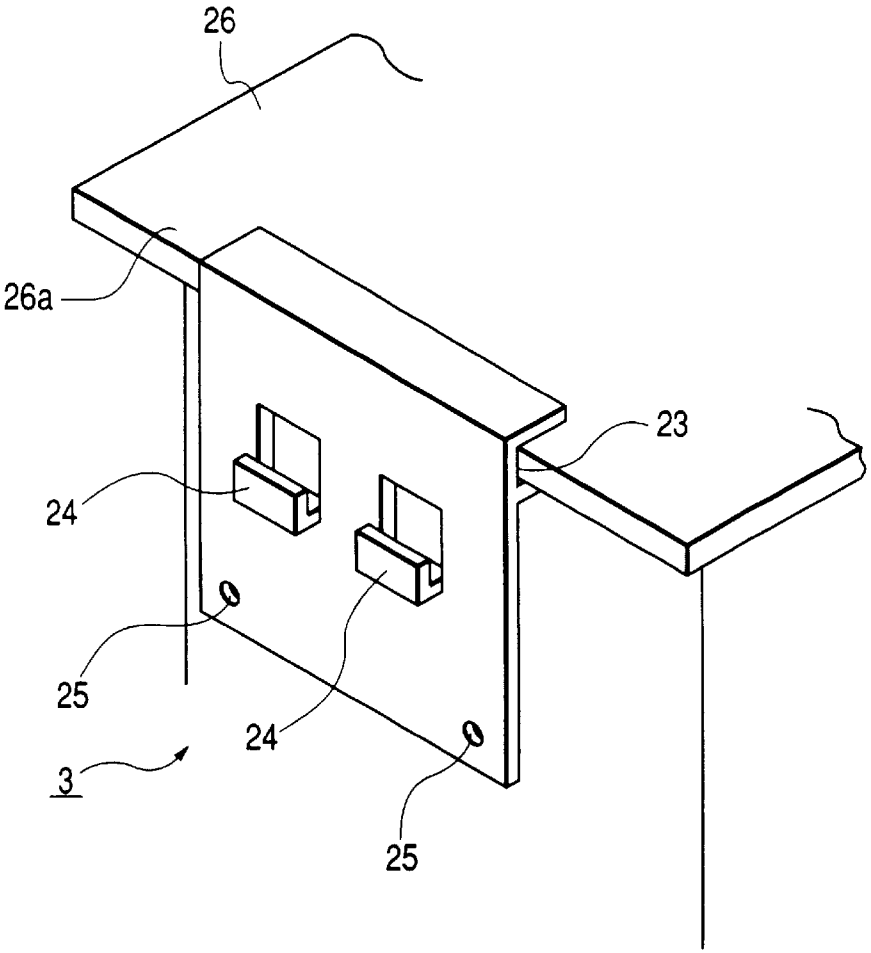

In conjunction with FIG. 1A to FIG. 4B, description will be made of an image recording apparatus in accordance with a first embodiment of the present invention. FIGS. 1A and 1B are views which illustrate an image recording apparatus in accordance with a first embodiment of the present invention. FIGS. 2A and 2B are views which illustrate a feeding cassette. FIG. 3 is a view which illustrates carrying means and recording means. FIGS. 4A and 4B are views which illustrate the way to fix a frame to a desk.

The image recording apparatus of the present embodiment is an ink jet recording apparatus 1 that records images by discharging ink, and which comprises an apparatus main body 2 and a frame 3. As shown in FIGS. 1A and 1B, the apparatus main body 2 comprises a feeding cassette container 4; a recording unit A; an outlet tray 5; an auxiliary guide 7; and a hooking unit 6. As shown in FIGS. 2A and 2B, the feeding cassette container 4 is structured to contain a feeding cassette 8. When replenishing recording mediums P, the feeding cassette 8 is removed out from the feeding cassette container 4. As shown in FIGS. 2A and 2B, the feeding cassette 8 comprises a spring 9, a stacking plate 10, nails 11, and a cassette cover 12. The spring 9 presses the stacking plate 10 on the nail 11 side so that the recording mediums P can be fed even when the number thereof on the stacking plate 10 is small.

The apparatus main body 2 performs image recording by recording means on a recording medium P in the recording unit A when the recording medium P housed in feeding cassette 8 is carried by carrying means to the recording unit A. As shown in FIG. 3, the carrying means comprises a pulse motor 13, carrying rollers 14 and 15, and pinch rollers 16. Then, the recording medium P is carried by means of the carrying rollers 14, which are connected with the pulse motor 13, toward the position where recording is made by recording means, thus arriving at the nipping portion formed by the carrying rollers 15 and the pinch rollers 16. Here, the carrying roller 15 rotates by means of a carrying motor (not shown) serving as the driving source so as to lead out the recording medium P to the lead-out tray 5, while image recording is being made by recording means.

The recording means of the present embodiment has a recording head 17 of ink jet type which is detachably mounted on a carriage 18. The carriage 18 is carried by means of a timing belt (not shown). The carriage 18 is guided by a guide shaft 19 to reciprocate and scan in the main scanning directions (directions indicated by a double arrow A) that intersect with the carrying direction of the recording medium P when driven by means of a carriage motor (not shown). Thus, accompanied by the conveyance of the recording medium P using carrying means, image recording is made by discharging ink from the recording head 17 in accordance with the image information which is transmitted through a communication cable.

In this respect, the structure is arranged to record by discharging ink from ink discharge ports by means of the growth and shrinkage of bubbles by utilization of film boiling created in the ink by the application of thermal energy generated by electrothermal converting elements when energized in accordance with recording signals. The typical structure and principle of this ink discharge should preferably be those using the fundamental principle disclosed in the specifications of U.S. Pat. Nos. 4,723,129 and 4,740,796, for example. The method thus disclosed is applicable both to the so-called on-demand type and continuous type apparatuses. Particularly for the on-demand type, each of the electrothermal converting elements, which is arranged to face a sheet or liquid flow path that retains ink, can generate thermal energy by the application of at least one driving signal corresponding to recording information, which gives rapid temperature rise beyond nucleate boiling, hence creating film boiling on the thermoactive surface of the recording head to make the resultant formation of bubbles possible in liquid effectively corresponding to driving signals one to one. With the growth and shrinkage of each bubble, liquid is discharged through each of discharge ports so as to form at least one droplet. It is more preferable to arrange the driving signals to be in pulse configuration, because the growth and shrinkage of each bubble is then made instantaneous appropriately, hence attaining excellent liquid discharges in particular.

As shown in FIGS. 1A and 1B, the outlet tray 5 is provided with guides 20 and 21 to keep the recording medium P which has been led out in an appropriate position. The outlet tray 5 is set outside the recording means against a desk, wall, or the like in such a manner that the apparatus main body 2 is fixed to the desk or wall serving as a fixing member, and that the direction in which the recording mediums P are kept is downward. Then, the outlet tray 5 is made rotative in an angle of 180 degrees or more centering on a shaft 22 arranged between the recording unit A and the outlet tray 5 so that the apparatus main body 2 can be fixed in a desired position, while the outlet tray 5 is placed in such rotative condition. Therefore, the outlet tray 5 can be set at an appropriate angle freely depending on the fixing condition of the apparatus main body 2 whether it is installed on the wall, against a desk, on a desk, or the like. For example, when the tray is not in use, it may be directed downward to facilitate storage or when in use, it may be set horizontally so as to make it easier to observe recording mediums P.

The guide 20 is arranged on a part of the upper side of the outlet tray 5 to guide the recording medium P when being led out, and at the same time, it is structured so that the recording medium P can be observed by eye-sight. The guide 21 is arranged on the leading end portion of the outlet tray 5 to support recording mediums P so as not to allow them to fall off when the leading end portion of the outlet tray 5 is set at a position lower than the shaft 22.

Also, an appropriate step is arranged in the vicinity of the outlet portion of the outlet tray 5 in order to keep recording mediums P from returning reversely when the outlet tray is set at an angle so that its leading end portion is positioned upward.

The auxiliary guide 7 is a guide for leading recording mediums P into the outlet tray 5, and is positioned to face the shaft 22. This guide is a flexible member which is deformably interlocked with the inclination of the outlet tray 5 so that the recording mediums P can be brought into the outlet tray 5.

In this respect, the auxiliary guide 7 connects across the housing (a first housing) which comprises the feeding cassette container 4 and the recording unit A, and the outlet tray 5 (a second housing), and at the same time, guides the conveyance of the recording mediums P between these housings. This guide itself is a flexible member strong enough to maintain and support the outlet tray 5 in a condition where it rotates at an arbitrary angle to the housing of the recording unit A.

Here, also, it may be possible to maintain and support the outlet tray 5 by use of the shaft 22 without depending on the auxiliary guide 4 in a condition where it rotates at an arbitrary angle to the housing of the recording unit A. Further, it may be possible to maintain and support both housings after rotation by the cooperation of the auxiliary guide 4 and the shaft 22.

In this way, depending on the space of the place where the recording apparatus main body is installed, the outlet tray 5 is rotated appropriately with respect to the recording unit A so as to allow the housing of the feeding cassette container 4 and recording unit A and the housing of the outlet tray 5 to be kept in a position at a conveniently rotated angle, and not to allow them to get in the way when installed, thus making it possible to perform desired image recording on a recording medium. If there is still any applicable strength of the auxiliary guide 4 or the shaft 22, the recording unit A side may be rotated appropriately with respect to the outlet tray 5 and held in such position.

Here, in the outlet tray 5 and the auxiliary guide 7, the leading end of the recording medium P with images recorded thereon abuts against the auxiliary guide 7 of the outlet tray 5 in the carrying direction, and guided by the auxiliary guide 7 to be led out to the outlet tray 5. In the outlet tray 5, the upward position of the recording medium P is regulated by the guide 20 when being led out. Then, when the leading end of the recording medium P abuts against the guide 21, it is kept in the outlet tray 5.

The hooking unit 6, that forms the fixing means that fixes the apparatus main body 2 to a desk, wall, or the frame 3 which will be described later, is arranged on the back side of the apparatus main body 2 so that the recording medium P can be carried vertically upward.

As shown in FIGS. 4A and 4B, the frame 3 is arranged to mount the apparatus main body 2 detachably, which forms a part of fixing means to fix the apparatus main body to a desk or wall. It comprises a coupling recess 23, hooking portions 24, and a threaded hole 25. Then, as shown in FIG. 4B, the coupling recess 23 is coupled with the ceiling plate 26*a* of a desk 26 to fix the frame 3 to the desk 26 by means of a screw 27 from under the coupling recess 23.

Then, the hooking unit 6 is hooked to the hooking portions 24 which protrude upward, and the screw 28 is tightened through the threaded hole 25 to fix the frame 3. The apparatus main body 2 is then positioned to place the feeding cassette container 4 below the recording means so that the recording medium P can be carried upward in the vertical direction.

Also, the apparatus main body 2 can be installed on a desk for use so as to carry recording mediums P in the horizontal direction if the apparatus main body is removed from the frame 3. Also, the outlet tray can be used in a horizontal inclination, so as to carry recording mediums P in the horizontal direction. Here, if the condition of the installation is insecure, it is possible to make the installation secure by use of a pedestal or the like.

As described above, with the apparatus main body 2 being fixed to the edge of the ceiling plate 26*a* of a desk 26, it becomes possible to free up more working space on the desk. Also, the range of selection is increased such as to fix the apparatus main body to a desk or wall or to fix it on a desk vertically or horizontally, among others orientations. As a result, the installation thereof becomes possible on various places selectively.

Second Embodiment

Figure 5:
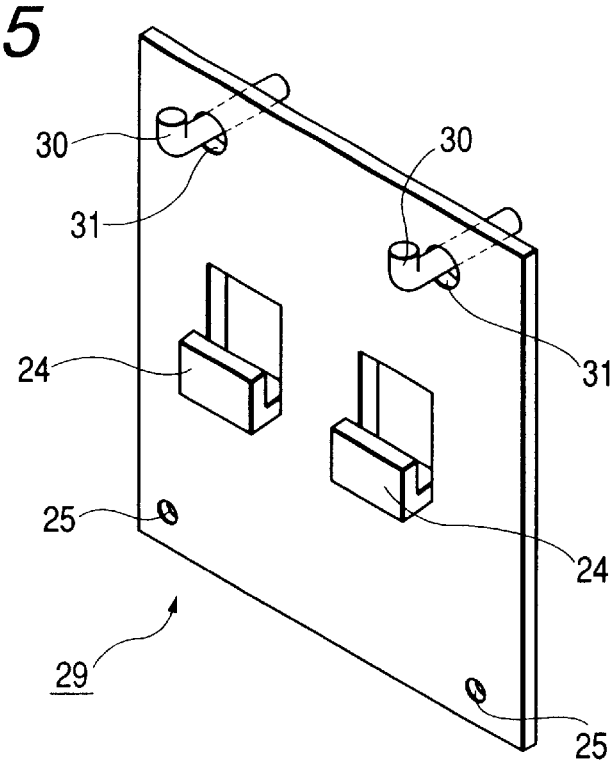
FIG. 5 is a view which illustrates a frame in accordance with a second embodiment of the present invention.

Now, with reference to the accompanying drawings, an image recording apparatus will be described in accordance with a second embodiment of the present invention. FIG. 5 is a view which illustrates a frame for use in a wall installation. For the parts which overlap with those of the first embodiment described above, the same reference numerals are used, and the description thereof will be omitted.

As shown in FIG. 5, the frame 3 fixed to the ceiling plate 26*a* as described in the previous embodiment is now arranged to be a frame 29 to be installed on hooks 30 for the image recording apparatus of the present embodiment. For the frame 29, holes 31 are provided instead of the coupling recess 23. The frame 29 is fixed to a desk 26, wall, or the like by hooking it to the hooks 30 by way of the holes 31.

Then, in the same manner as the first embodiment, the hooking unit 6 is hooked to the hooking portions 24 to fix the apparatus main body 2 to the frame 29 by tightening the screws 28 to the threaded holes 25.

For the embodiment described above, the frame is used as means for fixing the image recording apparatus, but it may be possible to fix the apparatus main body 2 directly to a desk, wall, or the like. Also, even when the frame is used, the frame is not necessarily limited to the configuration of the above embodiment. It may be possible to change the configuration or the like depending on the room arrangement, the material of a desk or wall, among other considerations.

Third Embodiment

Now, in conjunction with the accompanying drawings, description will be made of an image recording apparatus in accordance with a third embodiment of the present invention. For the parts where the description is overlapped with those of the first embodiment, the same reference numerals are used, and the description thereof will be omitted.

Figure 6A:
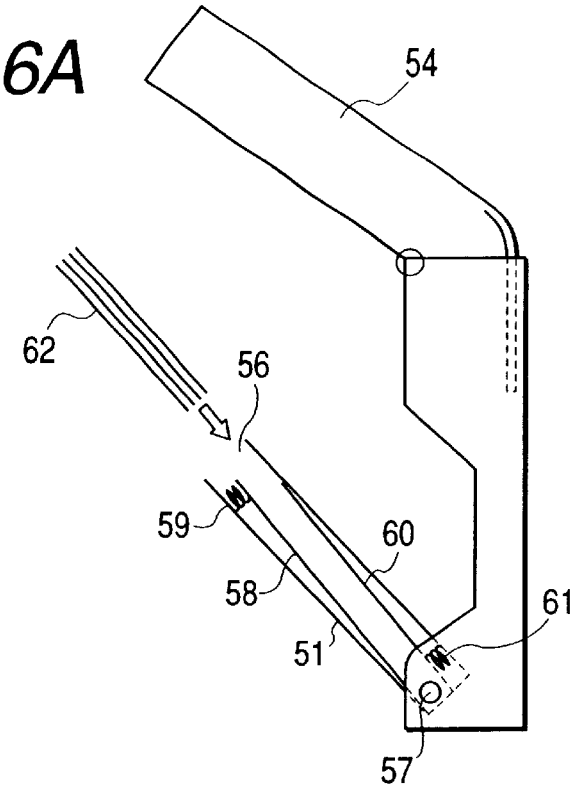
FIGS. 6A and 6B are views which illustrate a frame in accordance with a third embodiment of the present invention.

In FIG. 6A, a reference numeral 56 designates the sheet storing inlet which is arranged on the upper part of a sheet container 51; 57, the rotational shaft which is provided to incline the sheet container 51 for placing the sheet storing inlet 56 forward; 58, the front sheet pressure plate which is provided for the front side of the sheet container 51; 59, a spring, serving as an elastic member to act on the front sheet pressure plate 58; 60, the rear sheet pressure plate which is provided for the rear side of the sheet container 51; and 61, a spring serving as an elastic member to act on the rear sheet pressure plate 60.

Now, description will be made of procedures to be taken in supplying sheets to the sheet container 51.

In FIG. 6A, a sheet outlet tray 54 is raised at an appropriate angle to retract it from the front of the sheet container 51. Then, the sheet container 51 is inclined forward centering on the rotational shaft 57 in order to place the sheet storing inlet 56 forward. In this case, the springs 59 and 61 are provided with a mechanism to allow them to contract if the angle of the sheet container 51 is increased beyond a specific angle, thus making it easier to supply sheets to or remove them from the container.

Figure 6B:
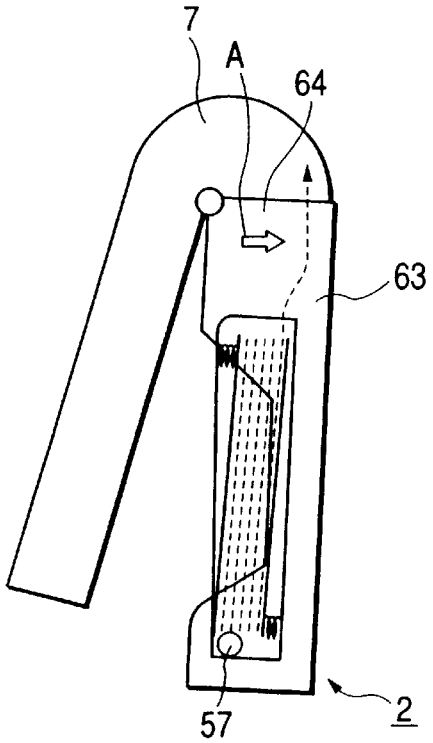

Now, as shown in FIG. 6B, the sheet pressure plates 58 and 60 press and fix sheets by action of the springs 59 and 61 subsequent to recording sheets having been inserted from the sheet storing inlet 56. Further, as shown in FIG. 6B, the sheet container 51 is returned to the original position, and also, the sheet outlet tray 54 is returned to an appropriate position. With the pressure exerted by the sheet pressure plates 58 and 60, it becomes possible to prevent sheets from being buckled when stored irrespective of the number of sheets, large or small. In the case of the present embodiment, a recording sheet 63 on the rear side of the sheet container 51 is carried by means of a carrying roller to the recording unit A where images are recorded on the recording sheet by discharging ink from an ink jet recording head serving as recording means in the direction indicated by an arrow 64. Therefore, the reverse side of the recording sheet which is led out to the outlet tray 54 becomes the recording surface, but when recording is made on plural pages, this setup is convenient, because the page order is not reversed. Also, on the side face and back side of the recording apparatus, no mechanism is arranged for attaching or detaching any member to or from the apparatus. Only the front side thereof needs space, thus making it possible to achieve more space saving.

Fourth Embodiment

Now, in conjunction with the accompanying drawings, description will be made of an image recording apparatus in accordance with a fourth embodiment of the present invention. For the parts where the description is overlapped with those of the third embodiment, the same reference numerals are used, and the description thereof will be omitted.

Figure 7:
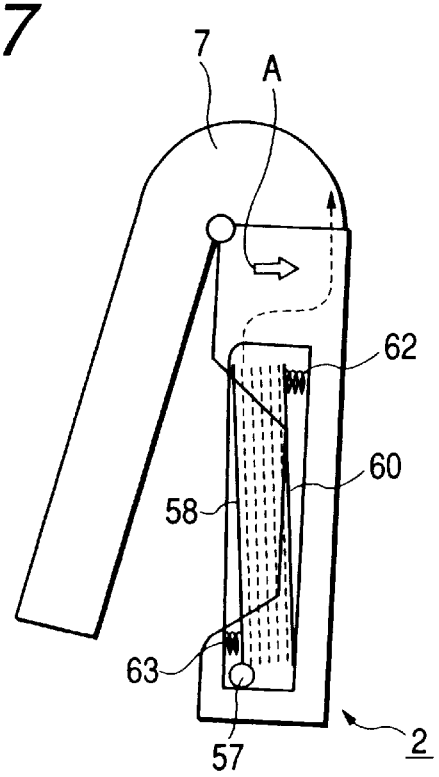
FIG. 7 is a view which illustrates a frame in accordance with a fourth embodiment of the present invention.

In FIG. 7, a reference numeral 62 designates a spring that acts upon the front sheet pressure plate 58, and 63, a spring that acts upon the rear sheet pressure plate 60. As is clear from FIG. 7, the structural difference of the present embodiment from the third embodiment described above is that the biasing direction of the springs 62 and 63 to the sheets is reversed. With this arrangement, the upper part of each of the sheets is inclined forward when stored, which makes it possible to handle recording sheets in such a manner that the sheets are not allowed to face the perpendicular direction when recording sheets are inclined along with the insertion or removal thereof. Therefore, the present embodiment thus structured enables recording sheets to be handled in a condition which is more stable than that of the third embodiment.

Now, for each of the embodiments described above, the description has been made by exemplifying the use of an apparatus of the ink jet recording type as the recording means, but the present invention is not necessarily limited to the use of the ink jet recording type. The invention is applicable to thermal transfer recording, heat sensitive recording, wire-dot or some other impact recording, or recording types other than those mentioned above.

What is claimed is:

1. An image recording apparatus for recording images on a recording medium by use of recording means, comprising:

a first housing provided with a feeding tray for containing recording mediums before recording by the recording means;

a second housing provided with an outlet tray for storing the recording mediums carried from said first housing; and coupling and carrying means for coupling said first housing and said second housing in such a manner as to be able to displace them relatively, said coupling and carrying means forming a flexible carrier path to guide a recording medium carried from said first housing to said second housing.

2. An image recording apparatus according to claim 1, wherein said coupling and carrying means is deformable from a linear form up to a U-letter form interlocked with the relative displacement of said first housing and said second housing, and supports the position of said first housing and said second housing after the relative displacement in such a manner as to be able to maintain said position.

3. An image recording apparatus according to claim 1, wherein recording is executable on the recording medium by arranging said first housing to be positioned above said coupling and carrying means.

4. An image recording apparatus according to claim 1, further comprising a structure to install said first housing on an inclined plane.

5. An image recording apparatus according to claim 1, wherein said feeding tray comprises a storing aperture for storing recording mediums in said feeding tray, and supporting means for supporting said storing aperture rotatively with respect to said first housing.

6. An image recording apparatus according to claim 1, wherein said outlet tray is provided with pressure members for biasing said recording mediums in such a manner as to prevent them from being buckled when led out to said outlet tray.

7. An image recording apparatus according to claim 1, wherein said recording means is ink jet recording means for recording on a recording medium by discharging ink from ink discharging ports.

8. An image recording apparatus according to claim 7, wherein said ink jet recording means uses thermal energy to discharge ink.

* * * * *